US010614698B2

(12) United States Patent
Takagi

(10) Patent No.: US 10,614,698 B2
(45) Date of Patent: Apr. 7, 2020

(54) MISPLACING PREVENTION DEVICE

(71) Applicant: Yazaki Corporation, Tokyo (JP)

(72) Inventor: Hiroyasu Takagi, Makinohara (JP)

(73) Assignee: YAZAKI CORPORATION, Minato-ku, Tokyo (JP)

( * ) Notice: Subject to any disclaimer, the term of this patent is extended or adjusted under 35 U.S.C. 154(b) by 0 days.

(21) Appl. No.: 15/952,790

(22) Filed: Apr. 13, 2018

(65) Prior Publication Data

US 2018/0365967 A1 Dec. 20, 2018

(30) Foreign Application Priority Data

Jun. 20, 2017 (JP) ..... 2017-120534

(51) Int. Cl.
*G08B 21/24* (2006.01)
*G08B 21/02* (2006.01)

(52) U.S. Cl.
CPC ..... *G08B 21/24* (2013.01); *G08B 21/025* (2013.01); *G08B 21/0238* (2013.01); *G08B 21/0261* (2013.01); *G08B 21/0272* (2013.01)

(58) Field of Classification Search
CPC ..... G08B 21/24; G08B 21/0238; G08B 21/0272; G08B 21/025; G08B 21/0261
See application file for complete search history.

(56) References Cited

U.S. PATENT DOCUMENTS 8,351,547 B2 1/2013 Miyatani
9,439,166 B2 9/2016 Siomina et al.
2010/0188226 A1 7/2010 Seder et al.
2011/0241867 A1* 10/2011 Neal ..... B60N 2/002 340/457
2013/0012123 A1* 1/2013 DeLuca ..... A45C 13/18 455/39
2013/0196612 A1* 8/2013 Cepuran ..... H04W 4/023 455/404.1
2015/0077253 A1 3/2015 Spahl et al.
2016/0355122 A1* 12/2016 Cotter et al. ..... B60Q 1/50

FOREIGN PATENT DOCUMENTS

CN 202053944 U 11/2011
CN 102301749 A 12/2011
CN 104512324 A 4/2015
JP 2002271229 A 9/2002
JP 2005284771 A 10/2005
JP 2010066149 A 3/2010
JP 2010-239395 A 10/2010
JP 2012123491 A 6/2012
JP 2016-500212 A 1/2016

* cited by examiner

*Primary Examiner* — Ryan W Sherwin
(74) *Attorney, Agent, or Firm* — Sughrue Mion, PLLC

(57) ABSTRACT

A misplacing prevention device capable of preventing leaving items inside and outside a predetermined area is provided. A microprocessor, when a user enters a vehicle interior, determines that the slave device having the ID stored in the memory is not in the vehicle interior based on a communication between a master device and a slave device, detects carrying-in leaving, and notifies the fact. The microprocessor, when the user enters an outside of the vehicle, also notifies a position of the slave device in the vehicle interior.

11 Claims, 5 Drawing Sheets

SNOWBOARD CARRYING-IN LIST

| ID | NAME OF CARRYING-IN ITEM |
|---|---|
| 1 | WALLET |
| 2 | DRIVER'S LICENSE |
| 3 | CAR KEY |
| 4 | HOUSE KEY |
| 5 | MOBILE PHONE |
| 6 | BOARD |
| ⋮ | ⋮ |

PURCHASE CARRYING-IN LIST

| ID | NAME OF CARRYING-IN ITEM |
|---|---|
| 1 | WALLET |
| 2 | DRIVER'S LICENSE |
| 3 | CAR KEY |
| 4 | HOUSE KEY |
| 5 | MOBILE PHONE |
| 7 | ECO-BAG |
| ⋮ | ⋮ |

FIG.4

SNOWBOARD CARRYING-OUT LIST

| ID | NAME OF CARRYING-IN ITEM |
|---|---|
| 1 | WALLET |
| 3 | CAR KEY |
| 5 | MOBILE PHONE |
| 6 | BOARD |
| ⋮ | ⋮ |

PURCHASE CARRYING-OUT LIST

| ID | NAME OF CARRYING-IN ITEM |
|---|---|
| 1 | WALLET |
| 3 | CAR KEY |
| 5 | MOBILE PHONE |
| 7 | ECO-BAG |
| ⋮ | ⋮ |

FIG.5

| CARRYING-OUT LIST | PRESENCE/ABSENCE |
|---|---|
| WALLET | PRESENSE |
| XXXX | PRESENSE |
| XXXX | ABSENCE |
| ⋮ | ⋮ |

MISPLACING PREVENTION DEVICE

TECHNICAL FIELD

The present invention relates to a misplacing prevention device.

BACKGROUND ART

When getting on or off the vehicle, such wallet is often forgotten to carry out or carry in. However, conventionally, there has not been what notifies carrying-out leaving or carrying-in leaving of an item such as the wallet in a predetermined area such as a vehicle interior.

SUMMARY OF INVENTION

Technical Problems

The present invention has been made in view of the above background, and it is an object of the present invention to provide a device to prevent misplacing inside or outside a predetermined area.

Solution to Problem

A misplacing prevention device, which is an aspect of the present invention, is a misplacing prevention device, including a master device for performing wireless communication with a slave device attached to an item, and a notification unit for performing notification to prevent misplacing of the item inside and outside a predetermined area, based on a wireless communication between the slave device and the master device.

The above-mentioned predetermined area may be a vehicle interior.

Preferably, the misplacing prevention device further includes a storage unit for storing an identification data of the slave device attached to the item required to be carried out from the predetermined area, a carrying-out leaving detection unit for detecting carrying-out leaving when determining that the slave device corresponding to the identification data stored in the storage unit is located within the predetermined area based on the communication between the master device and the slave device when a user leaves the predetermined area, and the notification unit notifies carrying-out leaving.

Preferably, the misplacing prevention device includes a position detection unit for detecting a position of the slave device, and when the carrying-out leaving detection unit detects carrying-out leaving, the notification unit notifies the position of the slave device located in the predetermined area detected by the position detection unit.

Preferably, the misplacing prevention device, further includes a position detection unit for detecting a position of the slave device, and when a user leaves the predetermined area, the notification unit notifies the position of the slave device located in the predetermined area and detected by the position detection unit.

Preferably, the notification unit has an illuminating unit for performing notification by illuminating the position detected by the position detecting unit with the illuminating unit.

Preferably, the misplacing prevention device further includes a storage unit for storing an identification data of the slave device attached to the object required to be brought from the predetermined area, and a carrying-in leaving detection unit for detecting carrying-in leaving when determining that the slave device corresponding to the identification data stored in the storage unit is out of the predetermined area based on the communication between the master device and the slave device when the user enters the predetermined area or when the user wants, and when the carrying-in leaving detection unit detects carrying-in leaving, the notification unit notifies carrying-in leaving.

Preferably, the carrying-in leaving detection unit determines that each of all slave devices corresponding to the identification data stored in the storage unit locates within the predetermined area, and the notification unit displays a list of slave devices determined not to exist in the predetermined area.

Advantageous Effects of Invention

As described above, according to the present invention, it is possible to prevent leaving of item inside and outside the predetermined area.

BRIEF DESCRIPTION OF THE DRAWINGS

FIG. 4 is a diagram showing an example of a carrying-in list stored in the memory shown in FIG. 1;

FIG. 5 is a diagram showing an example of a carrying-out list stored in the memory shown in FIG. 1;

DESCRIPTION OF EMBODIMENTS

First Embodiment

Figure 1:
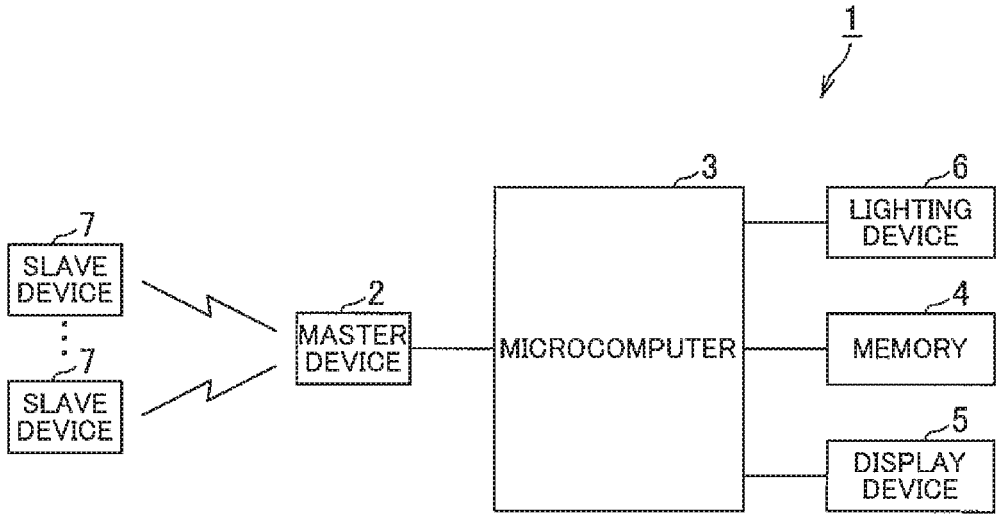
FIG. 1 is a block diagram showing an embodiment of a misplacing prevention device of the present invention.

A first embodiment of the present invention will be described below with reference to FIGS. 1 to 5. FIG. 1 is a block diagram showing an embodiment of a misplacing prevention device 1. The misplacing prevention device 1 shown in FIG. 1 is mounted on a vehicle. As shown in the figure, the misplacing prevention device 1 includes a master device 2, a micro computer (hereinafter referred to as a microcomputer) 3, a memory 4 as a storage unit, a display device 5, and an illuminating device 6 as an illuminating unit.

Figure 2:
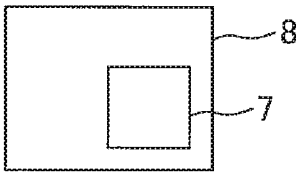
FIG. 2 is a view showing a state in which the slave device shown in FIG. 1 is formed into a shape of a seal and is attached to an object.
Figure 3:
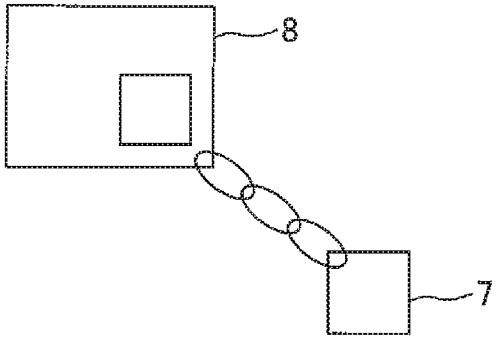
FIG. 3 shows a state in which the slave device shown in FIG. 1 is attached to an object in the form of a tag or a key holder.

The master device 2 is composed of a known communication unit that wirelessly communicate, and performs wireless communication with the slave device 7. The master device 2 stores an identification data (ID). The slave device 7 is attached to an item which is required to carrying-in or carrying-out into or from a vehicle (hereinafter referred to as "carrying-in/carrying-out") 8, such home key, or wallet. As shown in FIG. 2, the slave device 7 may be formed in a shape of a seal and attached to the carrying-in/carrying-out item 8, or as shown in FIG. 3, formed in a shape of a tag or a key holder, and attached to the carrying-in/carrying-out item.

The microcomputer 3 is composed of CPU, ROM, RAM, etc., and controls the whole of the misplacing prevention device.

As shown in FIG. 4 and FIG. 5, the memory 4 stores a list of the carrying-in/carrying-out item 8, which is previously registered by a user. This list stores various data such as a name of the carrying-in/carrying-out item 8, which is associated with the identification data (ID) attached to carrying-in/carrying-out item 8 the user previously registered. In this embodiment, as shown in FIGS. 4 and 5, a list of carrying-in items into the vehicle and a list of carrying-out items from the vehicle can be configured to be separately registered. In addition, in the present embodiment, lists can be configured to be separately registered for each of the objects, such as a snowboard and a purchase.

The display device 5 may be, for example, a liquid crystal display mounted on a meter in an instrument panel of the vehicle, and is controlled by microcomputer 3.

The illumination device 6 is attached to the roof of the vehicle, for example, and is provided with a light source having directivity such as an LED, and a drive unit (not shown) that drives the direction of the light source, and is controlled by microcomputer 3. The illumination device 6 drives the direction of the light source by a drive unit, so as to change illuminating position.

Next, an operation of the misplacing prevention device 1 having the above-described configuration will be described with reference to the flowcharts of FIGS. 6 and 7.

The microcomputer 3, once detecting that user enters an interior of the vehicle (hereinafter referred to as the vehicle interior) that is a predetermined area, initiates a carrying-in process shown in FIG. 6. The microcomputer 3 may detect entry of the user into the vehicle interior when the user gets into a driver's seat and a seat switch is turned on, when the user inserts the seat belt, and a belt switch is turned on, or when an ignition switch is switched from off to on, for example.

In the above-mentioned carrying-in process, the microcomputer 3 controls the display device 5 and displays the message "Enter the purpose (step S1). In response to this, when the user operates an input section (not shown) to enter a purpose (for example, the snowboard or the purchase) (Y in step S2), the microcomputer 3 controls the master device 2 to start communication with the slave device 7 so as to acquire the ID of the slave device 7 (step S3).

Next, the details of the operation in the above step S3 will be described below. In step S3, for example, the microcomputer 3 transmits a transmission signal for requesting transmission of the ID. The slave device 7, when receiving the transmission signal, sends a return signal containing its own ID. The microcomputer 3 acquires the ID of the slave device 7 in the vehicle interior by receiving this return signal. When the above transmission signal is transmitted with a radio wave, the slave device 7 may receive power supply by converting the radio wave into electric power. Of course, the slave device 7 may be powered from the internal battery.

Also, in step S3, though the microcomputer 3 transmits the transmission signal, it is not limited to this, and may transmit the reception timing signal periodically. The slave device 7 periodically transmits a signal including its own ID in response to the reception of the timing signal.

Next, the microcomputer 3 functions as a carrying-in leaving detection unit, and compares the ID acquired in step S3 and the carrying-in list corresponding to the purpose entered in step S2, and detects carrying-in leaving (step S4). Here, if the purpose entered in step S2 is the snowboard, the microcomputer 3 compares the ID acquired in step S3 with the carrying-in list for the snowboard (see FIG. 4). And if the purpose entered in step S2 is the purchase, then microcomputer 3 compares the ID acquired in step S3 with the carrying-in list for the purchase (FIG. 4).

In step S4, when the microcomputer 3 determines that the ID listed on the carrying-in list cannot be acquired in step S3, in other words, that the slave device 7 having the ID described in the carrying-in list does not exist in the vehicle interior, it is determined that the user has forgotten to carry it in. In this case, the microcomputer 3 determines whether or not each slave device 7 of all the IDs exists in the vehicle interior of the vehicle 1. On the other hand, when the microcomputer 3 determines that all IDs listed in the carrying-in list can be retrieved in step S3, that is, all the slave devices 7 with the IDs listed in the carrying-in list are present in the vehicle interior, it is judged that the carrying-in is not forgotten.

The microcomputer 3, if determined that the carrying-in has been forgotten after detection of carrying-in leaving in step 4 (Y in step S5), functions as a notifying unit and notifies the fact (Step S6), and terminates the carrying-in process. In step S6, the microcomputer 3, for example, displays in the display device 5 the list of the names of the carrying-in items that could not be acquired, notifying the carrying-in leaving.

On the other hand, the microcomputer 3, when judging that there is no carrying-in leaving (N in step S5), may notify no carrying-in leaving, and terminate the carrying-in process.

Figure 7:
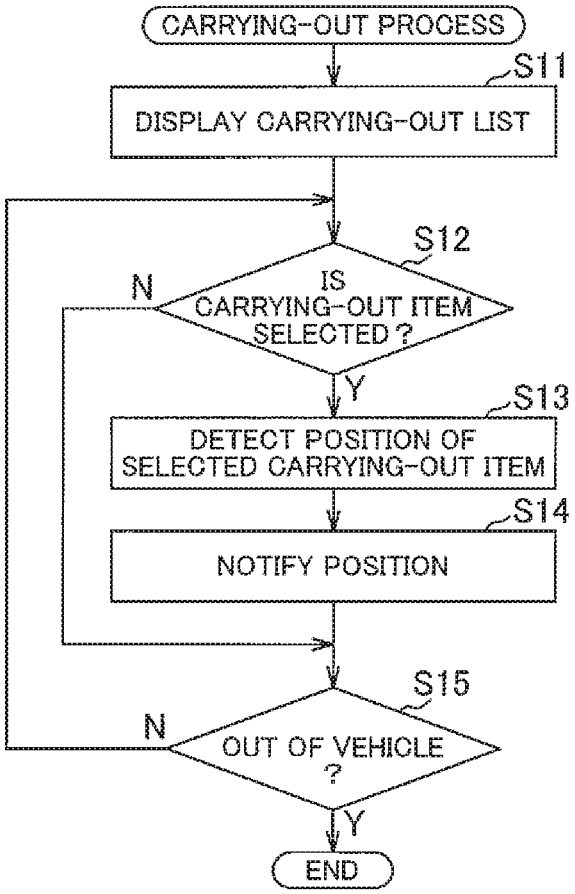
FIG. 7 is a flow chart showing a carrying-out procedure of the microcomputer shown in FIG. 1 in a first embodiment.

In addition, the microcomputer 3, when detecting that the user is going to leave the vehicle (in a state that the user is going to leave the vehicle though still staying in vehicle interior), starts carrying-out process shown in FIG. 7. The microcomputer 3, when the user releases the seat belt or when the ignition switch is switched from on to off, for example, detects that the user is going to leave the vehicle interior. In addition, the microcomputer 3, when detects arrival of the destination by the navigation device, may detect the user is going to move out of the vehicle interior.

In the carrying-out process, the microcomputer 3 displays on a display device 5 the carrying-out list corresponding to the purpose entered in step S2 of the carrying-out process (step S11). Here, the purpose is the snowboard, the microcomputer 3 lists, and displays on the display 5, the name of the carrying-out of the snowboard carrying-out list. The purpose entered in step S2 is the purchase, the microcomputer 3 lists, and displays on the display 5, the name of the purchase carrying-out list.

The user, if not see any items in the list displayed, operates a not-shown input unit to select the carrying-out item from the displayed list. The microcomputer 3, when the user selects the carrying-out items (Y in step S12), functions as a position detection unit, detecting the position of the slave device 7 attached to the selected item (step S13).

The position detection of the slave device 7 in step S13 may be performed by a known method using the communication between the master device 2 and the slave device 7. For example, the position can be detected based on a reflected wave at the slave device 7 of the radio wave transmitted from the master device 2. Otherwise, outputting a laser beam from the master device 2, the position may be detected based on a reflected wave at the slave device 7. Also, setting up two antennas on the master device 2, the position can be detected based on a difference in the reception time of the signal from the slave device 7 that two antennas have received.

After that, the microcomputer 3 controls the drive unit of the illumination device 6, orients the light source toward the position detected in step S13, and illuminates the position of the slave device 7, thereby notifying the position of the slave device 7 (step S14). After that, the microcomputer 3 returns the process to step S12 while the user does not enter an outside of the vehicle (step S15, N). On the other hand, when the user moves out of the vehicle interior (Y in step S15), the microprocessor 3 terminates the carrying-out process. The microprocessor 3, for example, if the user opens the door and the switch is turned on or when the user locks the door and the lock switch is turned off, detects that the user has entered the outside of the vehicle.

According to the first embodiment described above, the microcomputer 3 performs notification for prevention of leaving item inside or outside the vehicle based on the wireless communication between the slave device 7 and the master device 2. This enables prevention of leaving item inside or outside the vehicle.

Figure 6:
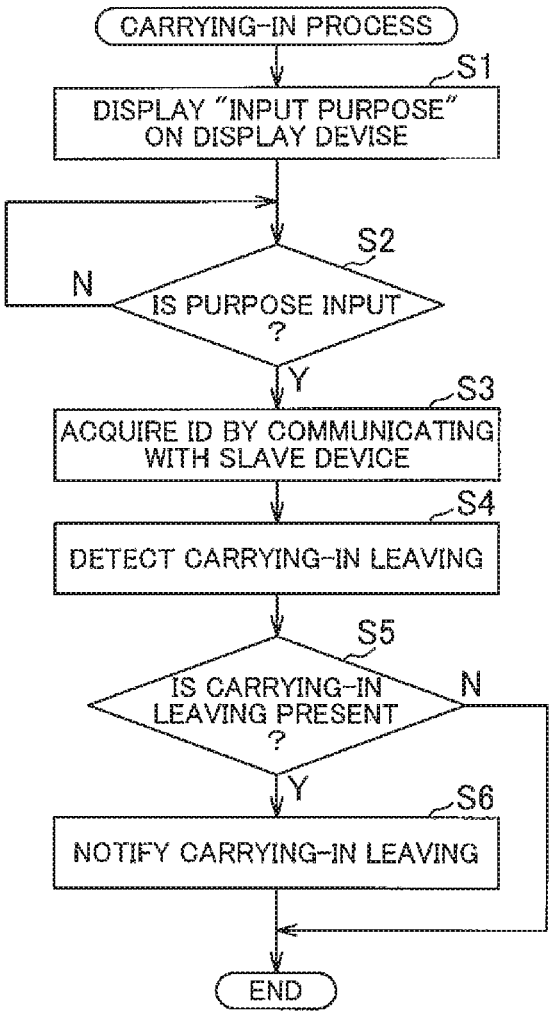
FIG. 6 is a flowchart showing a carrying-in procedure of a microcomputer shown in FIG. 1.

According to the above-described first embodiment, when the user enters the vehicle interior, the microcomputer 3, when determining that the slave device 7 listed in the carrying-in list does not exist in the vehicle interior as a result of communication between the device 2 and the slave device 7, detects carrying-in leaving and notifies the fact (the carrying-in process in FIG. 6). This enables prevention of carrying-in leaving of the item into the vehicle interior, to which the slave device 7 listed in the list is attached.

According to the above-described first embodiment, when the user is going to enter outside of the vehicle, the microcomputer 3 detects where the slave device 7 that exists in the vehicle, and notifies the position (carrying-out process in FIG. 7). This eliminates the need for the user to search the carrying-out item to which the slave device 7 is attached.

According to the first embodiment described above, the microcomputer 3 notifies the position of the slave device 7 by illuminating the position with the illumination device 6. Thus, even if the interior of the car is dark, the user can simply look up the slave device 7. In addition, the slave device 7 is placed under the seat or in the bag, illumination of the seat or the bag notifies, in a manner to easily identify, the user that the slave device 7 is placed under the seat or in the bag.

According to the first embodiment described above, though the microcomputer 3 detects the position of the slave device 7, and illuminates the position with the illumination device 6, it is not limited to this. The microcomputer 3 may judge whether or not there is a shield (such as a seat or a bag) between the master device 2 and the slave device 7. The microcomputer 3 can judge that there is a shield when the radio waves from the slave device 7 are weak in spite of proximity of the distance as a result of performing position detection of the master device 2 and the slave device 7 for example. Then, the microcomputer 3 changes the light emitting state of the lighting device 6 according to the presence or absence of the shield, and indicates the presence or absence of the item. For example, the microcomputer 3 has the illumination device 6 emit white light in the case of the presence of the shield, and has the illumination device emit red light in a case of absence of the shield. This can more easily report to the user the fact that the slave device 7 is located under the seat or in the bag.

According to the above-described first embodiment, though the microcomputer 3, when the ID listed in the carrying-out list cannot be obtained at step S3, determines misplacing occurs, it is not limited to this. The microcomputer 3 acquires the ID of the slave device 7 at step S3 and detects the position of the slave device 7. And the microcomputer 3 may judge that misplacing occurs even if the ID listed in the carrying-in list is retrieved at step S3 but the position of the slave device 7 is out of the vehicle interior.

According to the first embodiment described above, although the carrying-out list is preliminarily stored in the memory 4, it is limited to this. The carrying-out list may be not preliminarily stored. In this case, the microcomputer 3 writes to the carrying-out list the carrying-out item attached to all slave devices in the vehicle interior, via the communication between the master device 2 and the master device 7, automatically creating the list.

According to the above-described first embodiment, though the user inputs the object (steps S1 and S2 in FIG. 6), and the notification of the carrying-out and carrying-in is performed using the list corresponding to the entered purpose, it is not limited to this. The misplacing prevention device 1 is interlocked with a navigation device, and the list according to the destination entered in the navigation may be used.

According to the first embodiment described above, though carrying-in process is performed when the user is detected to enter the vehicle interior, it is not limited to this. For example, the microcomputer 3, when communication data is input which indicates notification request of the user for misplacing such as "notify misplacing" from a not-shown microphone, may starts the carrying-in process.

Second Embodiment

Next, a second embodiment will be described. In the first embodiment, because the carrying-out process is performed when the user is in the vehicle interior, the presence/absence of the carrying-out leaving is not detected. In the second embodiment, a portable terminal such as a smartphone that can be carried out from the vehicle interior and the misplacing prevention device are linked to each other, the presence/absence of the carrying-out leaving is thus detected and notified.

Figures 8, 9:
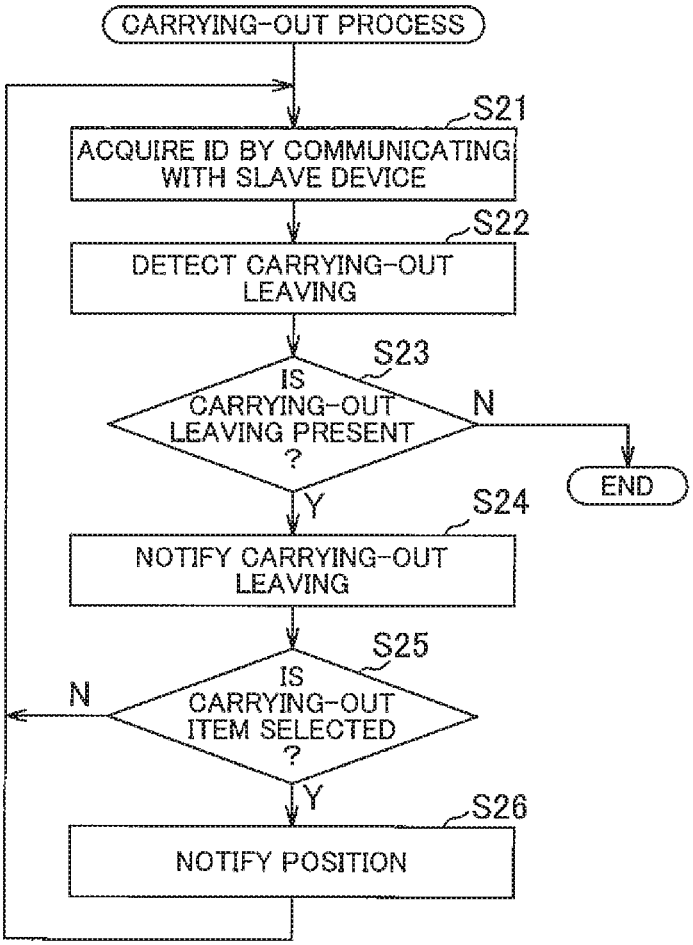
FIG. 8 is a flow chart showing a carrying-out procedure of the microcomputer shown in FIG. 1 in a second embodiment.
FIG. 9 is a diagram showing an example of a carrying-out list displayed on a display screen of a mobile terminal in the second embodiment.

With reference to the flowchart of FIG. 8, the operation of the misplacing prevention device in the second embodiment will be described. After checking that the user has moved out of the vehicle interior, the microcomputer 3 executes the carrying-out process as shown in FIG. 8. In the carrying-out process, the microcomputer 3 controls the master device 2 to communicate with the slave device 7, and acquires the ID of the slave device 7 (step S21).

Next, the microcomputer 3 functions as the carrying-out leaving detection unit, and compares the ID acquired in step S21 with the carrying-out list corresponding to the purpose entered in step S2, detecting carrying-out leaving (Step S22). Here the purpose entered in step S2 is the snowboard the microcomputer 3 compares the ID acquired in step S21 and the carrying-out list for the snowboard (FIG. 5). If the purpose entered in step S2 is the purchase, the microprocessor 3 compares the ID acquired in step S21 and the carrying-out list for the purchase (FIG. 5).

In step S22, the microcomputer 3 functions as the position detection unit and detects the position of the slave device 7 corresponding to the ID listed in the carrying-out list. The microcomputer 3, when judges that the position of the slave device 7 to which the ID is attached is in the vehicle interior, determines that carrying-out leaving occurs. On the other hand, the microcomputer 3, when judges that the positions of all the slave devices 7 to which the IDs listed in the carrying-out list are attached are out of the vehicle, determines that the carrying-out leaving does not occur.

When the carrying-out leaving is judged not to occur (N in step S23) as a result of performing the carrying-out process in the step S22, the microcomputer 3 immediately terminates the carrying-out process. Note that if it is judged that there is no leaving (N in step S23), the microcomputer 3 may terminate the process after displaying a message of "no carrying-out leaving." Contrary to this, the microprocessor 3, when finds any carrying-out leaving item (Y in step S23), functions as the notifying unit, and notifies the fact (step S24).

In step S24, the microcomputer 3 communicates with a mobile terminal brought out of the vehicle together with the user that is not shown in the figure, for example, displays such carrying-out list shown in FIG. 9 on a display panel of the mobile terminal, displaying presence or absence of the carrying-out item. In the example shown in FIG. 9, as a result of performing carrying-out leaving detection, for the carrying-out items corresponding to the slave device 7 judged to be in the vehicle interior, "absence" is shown as not carrying-out. On the other hand, if the slave device 7 is judged to be outside the vehicle interior, as for the item, "presence" is displayed as being carried out.

The user, if see a list of items displayed on the mobile device that says "absence" among the list displayed on the mobile terminal, operates the input section, which is not shown, to select the item marked "absence". The mobile terminal transmits this selection information to the misplacing prevention device 1. The microcomputer 3, when the selection is made (Y in step S25) by the user, controls the drive unit of the illuminating device 6 to orient the light source toward the position of the slave device 7 detected in step S22 and illuminates the position, thus notifying the position of the slave device 7 (Step S26). Then the microcomputer 3 returns to step S21. On the other hand, when the selection is not made (N in step S25) by the user even if a certain period of time has elapsed, the microcomputer 3 returns the process to step S21 again.

According to the second embodiment described above, when the user enters out of the vehicle interior, in the case that the slave device 7 having the ID stored in the memory 4 is judged to be in the vehicle interior based on the communication between the master device 2 and the slave device 7, the microprocessor 3 detects the carrying-out leaving. This can prevent items to which the slave device 7 in the carrying-out list is attached from carrying-out leaving.

According to the second embodiment described above, when detecting the carrying-out leaving, the microcomputer 3 notifies the position of the slave device 7 that exists in the vehicle interior. This eliminates the user to search the slave device 7.

According to the above-described second embodiment, though when the carrying-out leaving is detected, the carrying-out list is displayed on the mobile terminal so as to display the presence or absence of the carrying-out item, it is not limited to this. For example, if the carrying-out leaving is detected an alarm may be sounded a speaker installed on the car. At that time, it is also possible to illuminate the carrying-out items in the car with the light at the same time.

In addition, according to the first and second embodiments, though the microcomputer 3 detects the position of the slave device 7 attached to the carrying-out items in the vehicle interior, it is not limited to this. The position of the slave device 7 may not be detected according to an interference of electrical wave or the environment in the vehicle interior. Thus, in the first embodiment, if the position of the slave device 7 cannot be detected, the position is not reported and only the carrying-out list may be displayed. In addition, in the second embodiment, when the position of the slave device 7 cannot be detected, only the carrying-out leaving but not the position may be reported.

In addition, according to the first and second embodiments described above, though the position of the carrying-out item is notified using the lighting device 6, it is not limited to this. It may be sufficient to notify the position, the position of the carrying-out item may be notified by letting the slave device 7 sound.

In addition, the predetermined area is not limited to the vehicle interior, but, for example, may also be used to manage the goods if the area is designated such area as a store or warehouse.

Further, according to the first and second embodiments described above, though when the microcomputer 3 performs the carrying-in process and the carrying-out process, it is not limited to this. The microcomputer 3 may execute any one of the carrying-in process and the carrying-out process.

It should be understood that the present invention is not limited to the embodiments described above. That is, it can be implemented with various modifications without departing from the spirit of the invention.

REFERENCE SIGNS LIST

1 leaving prevention device
2 master device
3 microcomputer (Notification unit, carrying-out leaving detection unit, position
detection unit, carrying-in leaving detection unit)
4 memory (storage)
6 lighting device (lighting unit)
7 slave device

The invention claimed is:

1. A misplacing prevention device, comprising:

a master device, comprising a transmitter and a receiver, the master device configured to perform wireless communication with a slave device attached to an item, the slave device comprising a transmitter and a receiver;

at least one processor configured to perform notification to prevent the item from being left inside or outside a predetermined area based on the wireless communication between the slave device and the master device, and a memory configured to store an identification data of the slave device attached to the item required to be carried out from the predetermined area, wherein the at least one processor is configured to detect carrying-out leaving of the item when determining that the slave device corresponding to the identification data stored in the memory exists within the predetermined area based on the wireless communication between the master device and the slave device when a user leaves the predetermined area, wherein when the at least one processor detects the carrying-out leaving, the at least one processor notifies the carrying-out leaving, when the at least one processor detects the carrying-out leaving, the at least one processor notifies a position of the slave device within the predetermined area detected by the at least one processor, and the at least one processor is configured to, in the case where the slave device is in the predetermined area, determine whether an object is between the master device and the slave device, based on the wireless communication, and notifies whether the object is between the master device and the slave device.

2. The misplacing prevention device according to claim 1, wherein the predetermined area is an inside of a vehicle.

3. The misplacing prevention device according to claim 1, wherein when the user is going to leave the predetermined area, the at least one processor notifies the position of the slave device within the predetermined area detected by the at least one processor.

4. The misplacing prevention device according to claim 3, further comprising:

an illuminating unit, wherein the at least one processor is configured to notify the position detected by controlling the illuminating unit to illuminate.

5. The misplacing prevention device according to claim 4, wherein the at least one processor is configured to notify the position detected by controlling the illuminating unit to illuminate towards the position.

6. The misplacing prevention device according to claim 1, further comprising:

an illuminating unit, wherein the at least one processor is configured to notify the position detected by controlling the illuminating unit to illuminate.

7. The misplacing prevention device according to claim 6, wherein the at least one processor is configured to notify the position detected by controlling the illuminating unit to illuminate towards the position.

8. The misplacing prevention device according to claim 1, further comprising:

an illuminating unit, wherein the at least one processor is configured to notify whether the object is between the master device and the slave device by controlling the illuminating unit to illuminate.

9. A misplacing prevention device, comprising:

a master device, comprising a transmitter and a receiver, configured to perform wireless communication with a plurality of slave devices that are each attached to a respective item and that each include a respective transmitter and a respective receiver, each of the plurality of slave devices configured to have an associated identification information, and the master device is provided with a list associating, for each of the plurality of slave devices, the identification data of the slave device with the respective item of the slave device; and at least one processor configured to provide a notification to prevent an item, that has attached a slave device of the plurality of slave devices, from being left inside or outside a predetermined area based on the wireless communication between the slave device and the master device, wherein the at least one processor is configured to compare a position of the slave device, which is inside or outside the predetermined area, with the list to determine whether carrying-out leaving or carrying-in leaving of the item occurs based on the wireless communication between the slave device and the master device, and to provide the notification based on the comparison, and the list is plurally registrable according to a purpose.

10. The misplacing prevention device according to claim 9, where the at least one processor is further configured to determine whether each of the plurality of slave devices is located within the predetermined area corresponding to the list stored in a memory according to the purpose, and is configured to cause display of a list of slave devices of the plurality of slave devices determined not to exist or to exist in the predetermined area.

11. The misplacing prevention device according to claim 9, wherein the predetermined area is an inside of a vehicle.

* * * * *